United States Patent [19]

Moravec

[11] Patent Number: 4,804,186

[45] Date of Patent: Feb. 14, 1989

[54] PINBALL DROP TARGET ASSEMBLY

[75] Inventor: Robert L. Moravec, Schaumburg, Ill.

[73] Assignee: Premier Technology, Inc., Bensenville, Ill.

[21] Appl. No.: 127,660

[22] Filed: Dec. 2, 1987

[51] Int. Cl.[4] ..... A63D 3/02

[52] U.S. Cl. ..... 273/127 R; 273/121 A

[58] Field of Search ..... 273/108, 118 R, 118 A, 273/118 D, 119 R, 119 A, 121 R, 121 A, 122 R, 122 A, 123 R, 123 A, 124 R, 124 A, 125 R, 125 A, 127 R

[56] References Cited

U.S. PATENT DOCUMENTS

| | | | |
|---|---|---|---|
| 180,226 | 7/1876 | Gurny et al. | 273/127 R |
| 240,334 | 4/1881 | Pittman | 273/127 R |
| 294,590 | 3/1884 | Crandall | 273/127 R |
| 343,088 | 6/1886 | Stiker | 273/127 R |
| 923,830 | 6/1909 | Grounds | 273/127 R |
| 1,325,921 | 12/1919 | Amlie | 273/127 R |
| 1,534,522 | 4/1925 | Halliday | 273/118 D |
| 1,949,488 | 3/1934 | Rockola | 273/121 A |
| 2,095,513 | 10/1937 | Reznick | 273/38 |
| 2,830,819 | 4/1958 | Pearl | 273/121 A |
| 3,078,096 | 2/1963 | Wisner | 273/41 |
| 3,927,884 | 12/1975 | Glass et al. | 273/119 R |
| 4,037,842 | 7/1977 | Breslow | 273/127 R |
| 4,190,252 | 2/1980 | Kindig | 273/127 R |
| 4,243,222 | 1/1981 | Grabel et al. | 273/127 R |
| 4,257,604 | 3/1981 | Grabel et al. | 273/127 R |
| 4,354,681 | 10/1982 | Garbark | 273/127 R |
| 4,438,929 | 3/1984 | Peters | 273/127 R |
| 4,460,175 | 7/1984 | Krynski | 273/121 A |
| 4,508,343 | 4/1985 | Peters et al. | 273/127 R |

FOREIGN PATENT DOCUMENTS

| | | |
|---|---|---|
| 2812173 | 3/1978 | Fed. Rep. of Germany . |
| 1418509 | 12/1975 | United Kingdom . |

*Primary Examiner*—Robert E. Garrett
*Assistant Examiner*—John T. Kwon
*Attorney, Agent, or Firm*—Arnold, White & Durkee

[57] ABSTRACT

A drop target assembly for a pinball type amusement game includes a frame that is mounted to the under surface of a play field. An elongated target extends through a slot in the play field and is reciprocally mounted in the frame. The target is moveable from a position below the play field to a latched position above the play field by a resetting assembly. In a position above the play field, the target may be struck by a playing object which will release the target causing it to drop to the position below the play field. The resetting assembly includes a target stop member mounted on the frame for reciprocating movement vertically relative to the play field. The target stop member holds one end of the target in the position below the play field and is out of engagement with the target in the position above the play field. The resetting assembly further includes a solenoid with a plunger coupled to the target stop member. The plunger extends parallel to a longitudinal axis of the target.

19 Claims, 3 Drawing Sheets

PINBALL DROP TARGET ASSEMBLY

FIELD OF THE INVENTION

The present invention relates to a new and improved target for an amusement device, and more particularly, to a new and improved drop target assembly for a pinball type amusement device.

DESCRIPTION OF THE BACKGROUND ART

Pinball games have been popular for a period of time far exceeding the popularity of other amusement games. An example of this is a comparison of the popularity of pinball games and the PAC MAN video game. Pinball games were popular prior to the introduction of the PAC MAN game and are still popular while the popularity of PAC MAN games has wanned.

The popularity of pinball games is due, at least in part, to the thought and ingenuity of pinball game designers in incorporating features into the game that increase the excitement experienced by the player and produce different results and scores for each game played. One feature that has been successfully included in pinball machines is a drop target. A drop target includes a target that extends above the play field of the pinball machine which once hit by the game ball, drops below the play field. Points are scored when each target is hit by the game ball. An example of a drop target for a pinball machine may be found in U.S. Pat. No. 4,460,175 and this patent is incorporated by reference.

The typical prior art drop target, however, limits the alternatives available in the design of pinball machine play fields. The minimum size of prior art drop targets is large and since the size of a play field is limited, there are only a few locations on a play field that a prior art drop target can be placed. The size of prior art drop targets also prevents positioning two or more drop target assemblies close together on a play field.

In addition to their large size, prior art drop target assemblies are of a complex structure making servicing in the field very difficult. Prior art drop target assemblies typically include a rod extending through a trigger for each target. The ends of the rod are held by a yoke that is connected to an armature of a solenoid. To service one of the targets, the entire drop target assembly must be dismantled. Dismantling requires pulling the armature out of the solenoid, removing the yoke, withdrawing the rod, and repairing the target.

The unwieldly size of the prior art drop target assemblies is due in part to the necessity of placing the reset coil at an angle to the frame of the assembly, and to the limitation that the minimum number of targets in a drop target assembly is three. The reset coil resets the targets to the position above the play field. To have the necessary leverage to reset the targets, the typical reset coil is mounted at an angle to the frame of the drop target assembly such that the reset coil extends outwardly from the frame. This alignment of the reset coil requires substantial space and prevents close positioning of drop target assemblies. The frame of prior art drop target assemblies also requires a minimum of three targets. The size of the frame for three targets is the smallest size that will provide sufficient structure to secure the assembly to the underside of the play field.

It would be desirable to have a drop target assembly that requires minimum space and can have as few as one target while allowing drop target assemblies to be positioned adjacent to each other. A drop target assembly of this type would allow designers to create previously unavailable arrays of drop targets on play fields of pinball games.

SUMMARY OF THE INVENTION

An object of the present invention is to provide a new and improved amusement game.

Another object of the present invention is to provide a new and improved pinball type amusement game.

A further object of the present invention is to provide a new and improved drop target assembly for a pinball machine.

A still further object of the present invention is to provide a new and improved drop target assembly that can be made to include only one target.

Another object of the present invention is to provide a new and improved drop target assembly for a pinball machine that is of a size and configuration allowing several drop target assemblies to be positioned adjacent to each other and in varying arrays on a play field.

Briefly, the present invention is directed to a new and improved device, commonly referred to as a drop target assembly, for a pinball machine. The drop target assembly is of a simplified construction allowing easy servicing. The simplified construction also allows as few as one target to be included in the assembly and permits close positioning of target assemblies in varying arrays on the play field of the pinball machine.

The drop target assembly includes a frame for holding one or more targets. The frame includes holding structure for securing the frame to the underside of a play field. An opening is provided in the play field to allow each target to extend above the play field in a first position and below the play field in a second position. A solenoid is secured to the frame in a position parallel to the frame in a configuration that minimizes the space required by the assembly. An armature of the solenoid is secured to a target stop member mounted on the frame for reciprocal movement in a direction parallel to a longitudinal axis of each target. In the second position of each target, a lower end of each target engages and is supported by the target stop member. In the first position of each target, each target is held in a position above the target stop member and above the play field by a releasable latch.

The drop target assembly may include one or more trip coils. The trip coils allow release of the targets when a ball or other playing object engages a remote target or trigger.

BRIEF DESCRIPTION OF THE DRAWINGS

The above and other objects and advantages and novel features of the present invention will become apparent from the following detailed description of a preferred embodiment of the invention illustrated in the accompanying drawings wherein.

DESCRIPTION OF THE PREFERRED EMBODIMENT

Figure 1:
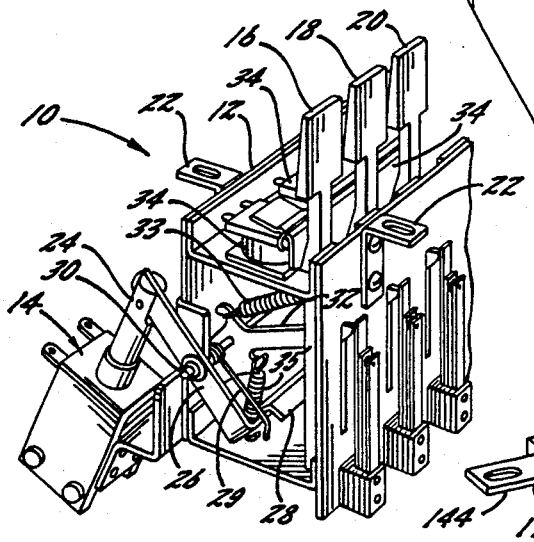
Fig. 1. (PRIOR ART)
FIG. 1 is a fragmentary perspective rear view of a prior art drop target assembly.
Figure 3:
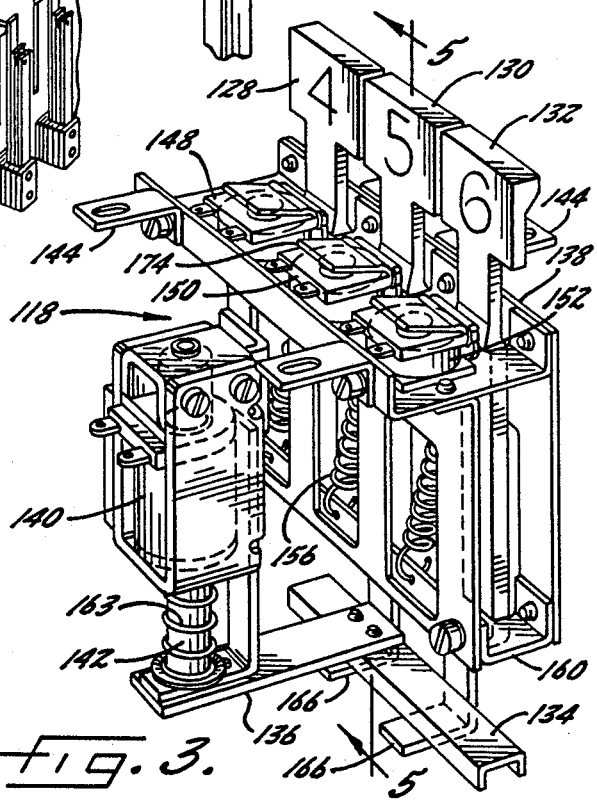
FIG. 3 is an enlarged, fragmentary perspective view taken generally along line 3—3 of FIG. 2 showing the front of a drop target assembly constructed in accordance with the principles of the present invention.
Figure 4:
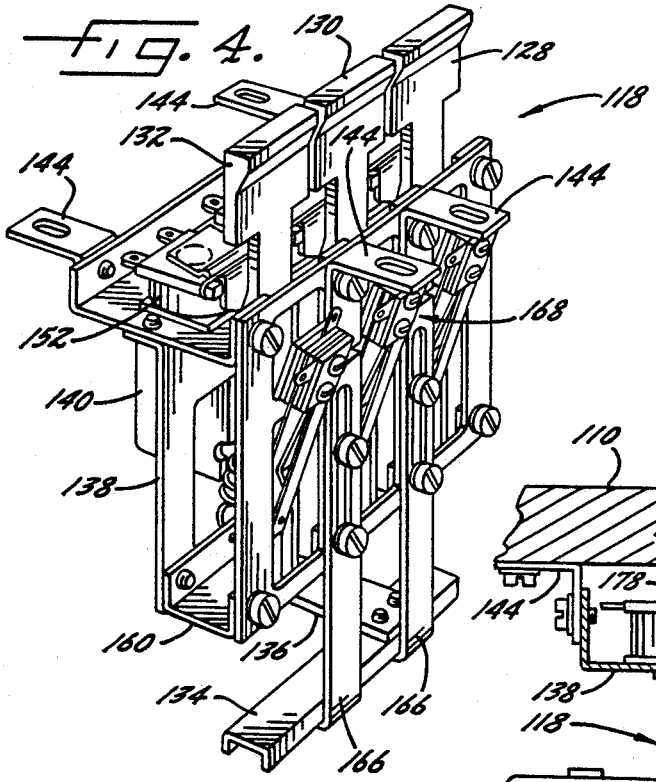
FIG. 4 is a view similar to FIG. 3 illustrating the rear of a drop target assembly constructed in accordance with the principles of the present invention.

Referring initially to FIG. 1, there is illustrated a prior art drop target assembly generally designated by the reference numeral 10. The drop target assembly 10 is an example of drop target assemblies that require a substantial amount of space below a pinball machine play field. The large amount of space is necessary to accommodate a frame 12 and a pair of solenoids 14 (only one is illustrated) that are mounted at an angle to the frame 12. A minimum of three targets 16, 18 and 20 are mounted for reciprocal movement in the frame 12. The minimum number of targets that can be included in the prior art assembly 10 is three since a frame 12 for fewer targets is too small to provide sufficient structure, such as angle brackets 22, to hold the frame 12 securely to the underside of a play field of a pinball machine. Due to the large amount of space required by assembly 10, designers have limited alternatives as to where to place the assemblies 10 on the play field of a pinball machine. Moreover, the assemblies 10 cannot be placed close together due to their space requirements.

To start a game, the targets 16, 18 and 20 are moved to an elevated position above the play field of a pinball game by the solenoids 14 as illustrated in FIG. 1. The solenoids 14 each include a plunger 24 pivotally connected to a yoke defined by a lever 26 and a cross bar 28. Upon energization of the solenoids 14, the plungers 24 are withdrawn to pivot the levers 26 about a rod 30 moving the cross bar 28 through an arc. The cross bar 28 engages arms or triggers 32 pivoting them about the rod 30. Each arm 32 extends through an aperture in a corresponding target 16, 18 and 20 and by pivoting the arms 32, each target is raised to the elevated position. Upon raising each target 16, 18 and 20, the solenoids 14 are deenergized and a spring 29 rotates the cross bar 28 downward away from the targets 16, 17 and 20. The targets 16, 18 and 20 are latched into the elevated position under the bias of springs 33. The targets 16, 18 and 20 remain in the elevated position until engaged by a playing object such as a ball or until a trip coil 34 is energized whereupon the targets 16, 18 and 20 are disengaged and are pulled to a position below the play field by springs 35. For a more detailed description of the structure of the drop target assembly 10 reference may be made to U.S. Pat. No. 4,460,175.

The drop target assembly 10 includes multiple parts interconnected together making servicing difficult and expensive. For example, to repair or replace one of the targets 16, 18 and 20, the plungers 24 must be disconnected from the levers 26, rod 30 must then be disconnected from levers 26 and pulled out of arms 32. The target to be repaired is disconnected from its corresponding trigger and springs. Upon completion of the repair or replacement, the entire assembly 10 must be reassembled. This procedure requires a significant amount of time and manual labor by a service person resulting in a large cost to the owner of the pinball machine.

Figure 2:
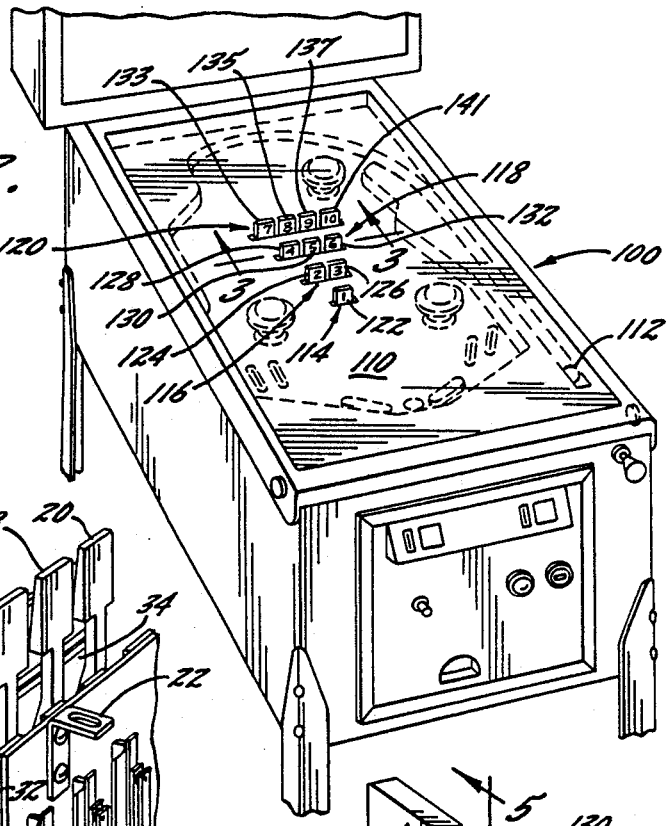
FIG. 2 is a perspective view of a pinball machine including a playing field with drop targets constructed in accordance with the principles of the present invention.

Referring now to FIG. 2, there is illustrated a typical pinball machine generally designated by the reference numeral 100. The pinball machine 100 includes a playing field 110 on which a playing object such as a ball 112 is put into play in accordance with the principles of the present invention. The play field 110 includes four drop target assemblies, generally designated by the reference numerals 114, 116, 118, and 120, respectively. The drop target assembly 114 includes one target 122; drop target assembly 116 includes two targets 124 and 126; drop target assembly 118 includes three targets 128, 130 and 132; and drop target assembly 120 includes four targets 133, 135, 137, and 141, respectively. The arrangement of the drop target assemblies 114, 116, 118 and 120 is in a configuration similar to that of bowling pins. This arrangement illustrates the ability of the drop target assembly of the present invention to include as few as one target or as many targets as desired. For example, drop target assemblies 114 and 116 both include fewer targets than was possible in the prior art such as the drop target assembly 10 which requires a minimum of three targets 16, 18 and 20.

The specific features and details of the drop target assembly of the present invention are best illustrated in FIGS. 3–8 in which the drop target assembly 118 is illustrated. The differences in the drop target assembly 118 of the present invention and the prior art drop target assembly 10 are best illustrated by a comparison of FIGS. 1 and 3. Specifically, the yoke defined by the lever 26 and cross bar 28 of the prior art target assembly 10 have been replaced by a U shaped channel target stop member 134 and a connecting arm 136 in target assembly 118. Also, the arms 32 in the prior art drop target assembly 10 have been completely eliminated in the drop target assembly 118. One result of the elimination of the arms 32, cross bar 28 and levers 26 is a narrower and smaller frame 138 in assembly 118. This allows the placement of drop target assemblies closer together as, for example, in the configuration illustrated in FIG. 2. Another result of levers 26 and cross arm 28 of prior art assembly 10 being eliminated in assembly 118 is that the solenoid 140 in the drop target assembly 118 may be repositioned. Specifically, the solenoid 140 is aligned parallel to the longitudinal axis of the targets 128, 130 and 132 rather than at an angle as in the alignment of solenoid 14. In addition, the plunger 142 of solenoid 140 also extends along an axis parallel to the axis of the target members 128, 130 and 132. The direction of the extension, as illustrated in FIGS. 5–8, is perpendicular to a plane defined by the play field 110. By the solenoid 140 and plunger 142 being perpendicular to the play field 110 and parallel to the targets 128, 130 and 132, significantly less space is required by the frame 138 and the solenoid 140 than the frame 12 and solenoid 14 of the prior art assembly 10.

Turning to the specific details of the drop target assembly 118, the drop target assembly 118 is depicted as including three targets, 128, 130 and 132. Each target 128, 130 and !32 is an elongated, molded flat strip of plastic. It is to be understood, however, that more or fewer targets may be included in a drop target assembly of the present invention. For example, the drop target assembly 114 includes a single target 122 whereas the drop target assembly 120 includes four targets 133, 135, 137 and 141.

The drop target assembly 118 is secured to the underside of the play field 110 by angle mounting brackets 144. The drop target assembly 118 is mounted to the underside of the play field !10 to position targets 128, 130 and 132 below a slot 146 in the play field !10. This position of the drop target assembly 118 allows the targets 128, 130 and 132 to drop from an exposed play position (FIG. 5) to a recessed position (FIG. 6) upon receiving a direct hit by the ball 112. The targets 128, 130 and 132 may be artificially dropped to the recessed position even though not struck by ball 112 when an electromagnet or trip coil 148, 150 or 152 is actuated upon a remote ball operated device on the play field 110 being engaged. The remote device may, for example, be a duplicate drop target assembly.

With specific reference to the drop target assembly 118, upon commencement of playing the pinball machine 100, the targets 128, 130 and 132 are elevated to the exposed play position (FIG. 5) by the solenoid 140 and the plunger 142. To raise the targets 128, 130 and 132, the solenoid 140 and plunger 142 are mechanically connected to the targets 128, 130 and 132 through the target stop member 134 and the connecting arm 136. Once the targets 128, 130 and 132 have been raised to the exposed position, the solenoid 140 is deenergized and the plunger 142 is extended by a spring 163 moving the target stop member 134 downward into resting engagement with a target stop member holding frame 166.

Figure 6:
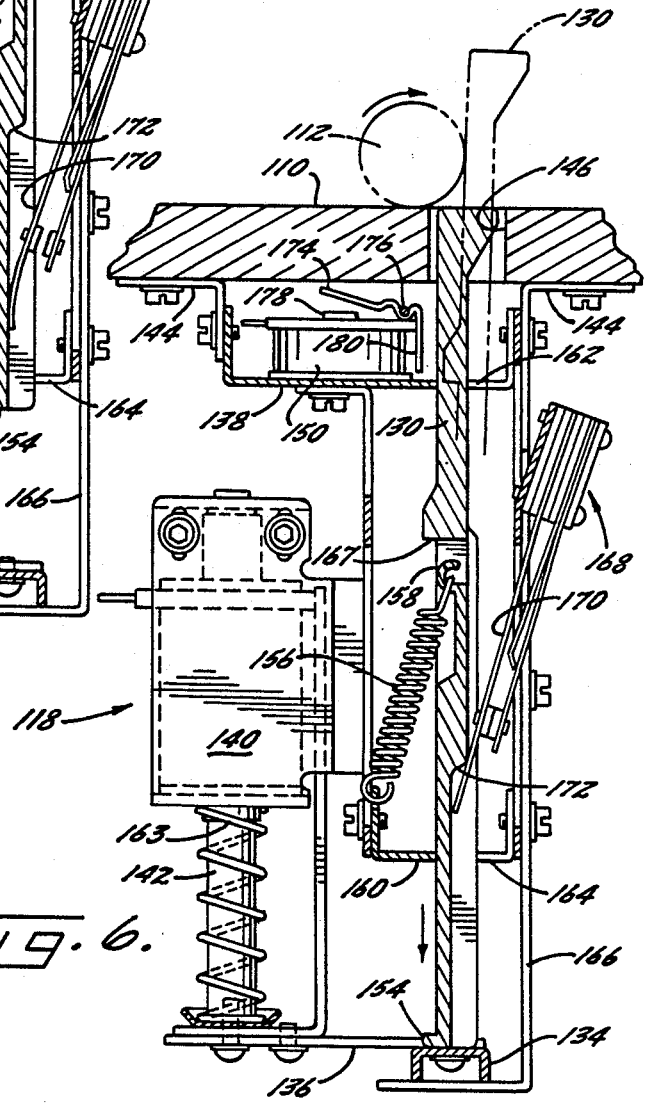
FIG. 6 is a view similar to FIG. 5 illustrating the engagement of a playing object with a target of the drop target assembly of the present invention.

As best illustrated in FIG. 6 and with specific reference to the target 130, the target 130 includes a lower end portion 154 that in the recessed position of the target 130, rests on the target stop member 134. The target 130 is biased to this position by a spring 156 that at first end is connected to the target 130 by securement to a hook 158 on the target 130 . A second end of the spring 156 is connected to a frame portion 160. The point of connection of the spring 156 to the frame portion 160 is at a location spaced away or behind the hook 158. This positioning of the two ends of the spring 156 provides a biasing force on the target 130 biasing the target 130 downward until lower end 154 engages the target stop member 134. The spring 156 also biases the target 130 against the rear edge of a slot 162 formed in frame 138 and the rear edge of a slot 164 formed in frame portion 160. The slots 162 and 164 are sufficiently wide to allow lateral movement of the target 130 to allow latching and unlatching of the target 130 as below described.

Figure 8:
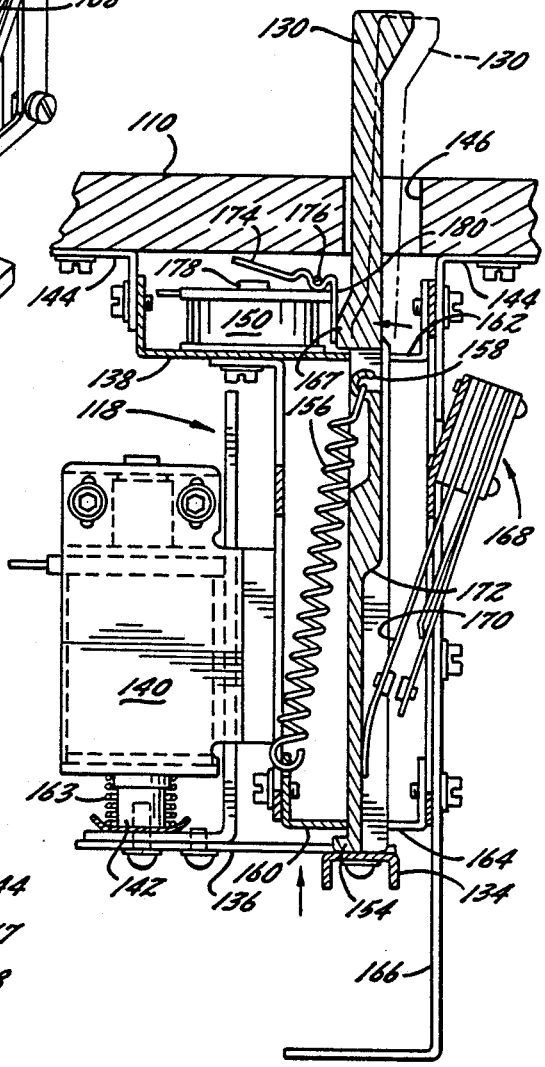
FIG. 8 is a view similar to FIG. 5 illustrating the elevation of a target to its elevated position locating a target member above the playing field.
Figure 7:
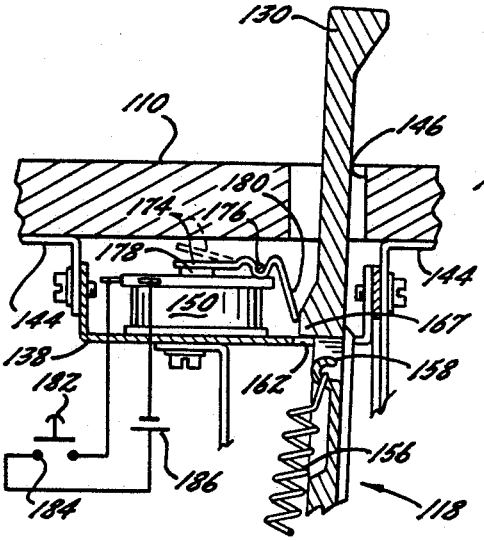
FIG. 7 is a fragmentary sectional view showing the operation of a trip coil releasing a latch to bring about an artificial drop of a target in a drop target assembly constructed in accordance with the principles of the present invention.
Figure 5:
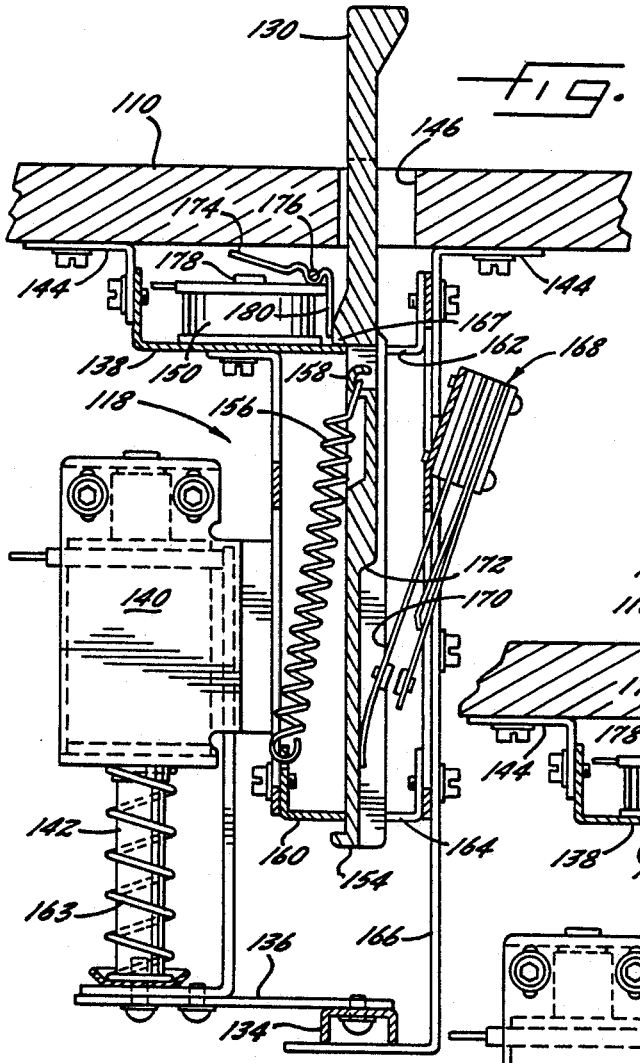
FIG. 5 is an enlarged view taken generally along line 5—5 of FIG. 3.

To raise the target 130 and the other targets 128 and 132 to the elevated or exposed position above play field 110, solenoid 140 is energized withdrawing plunger 142 and raising the target stop member 134 to the position illustrated in FIG. 8. In the upper position of the target 130, a shoulder 167 formed on target 130 is snapped over the rear edge of slot 162 and held in position by the biasing force of the extended spring 156. In the raised position of the target 130, a player sees the target 130 and can aim at the target with a ball 112 during the play of pinball machine 100.

Engagement of the ball 112 with the target 130 and dropping of the target 130 will result in a score being recorded. As best illustrated in FIG. 6, engagement of the ball 112 with the front of the target 130 moves the target 130 backward disengaging the shoulder 167 from the rear edge of the slot 162. The biasing force of the spring 156 then moves the target 130 downward until the lower end 154 of the target 130 engages the target stop member 134 resting on the target stop member holding frame 166. A score is recorded upon the dropping of the target 130 by a switch 16S that includes a blade 170. The blade 170 is wiped by a shoulder 172 formed on the target 130. Actuation of the switch 168 is best understood by comparing FIG. 6 and FIG. 8. In FIG. 8 the target 130 is in its elevated position and the switch 168 is open. Upon engagement of the target 130 with the ball 112 as illustrated in FIG. 6, the target 130 drops below the play field 110. As this occurs, the shoulder 172 engages the blade 170 closing the switch 168 resulting in a score being recorded by a scoring register (not shown) in the pinball machine 100.

The target 130 may also be dropped by engagement of the ball 112 with a remote target. Remote or artificial dropping of the target 130 is accomplished by the trip coil 150. The trip coil 150 includes an armature 174 pivotally mounted on a pin 176. Upon energization of the trip coil 150, a pole 178 pulls the armature 174 to the position illustrated in FIG. 7. This pivoting action causes a leg 180 of the armature 174 to engage the shoulder 167 of the target 130 unlatching the target 130. The target 130 is then moved to its recessed position below the play field 110 by the biasing action of the spring 156.

Energization of the trip coil 150 may occur in several different ways. One procedure includes a roll over button 182 (FIG. 7) that upon being engaged or rolled over by a ball 112, closes a switch 184 electrically connecting an interposed source of voltage 186 with the trip coil 150 thereby energizing trip coil 150 and releasing the target 130 from the latched position. This feature allows the target 130 to be dropped either by direct contact by the ball 112 or indirect contact resulting from the ball 112 engaging the roll over button 182. An alternative means of scoring points is provided by this feature adding a different facet of entertainment to the overall pinball machine 100.

Alternative means of energizing the trip coil 150 are available. For example, as described in U.S. Pat. No. 4,460,175, a second target assembly may be included in the pinball machine 100. This second target assembly includes targets and a switch similar to the switch 168. Upon engagement of the ball 112 with the second target, the second target engages the switch 168 in a manner similar to the closing of the switch by the shoulder 172 on the target 130. The switch is electrically connected to a trip coil causing an associated remote target also to drop below the surface of the play field 110.

Due to to the reduced size of the drop target assembly 118, servicing is significantly simplified. If, for example, target 130 is broken or otherwise needs replaced, a service person merely needs to disconnect spring 156 from hook 158 allowing removal of the target 130 and replacement by a new target. A single target can be repaired or replaced without disconnecting the other targets 128 and 132. Similarly, solenoid 140 or trip coil 150 is also easily removed and replaced by a service person merely by loosening a few fasteners. A similar procedure may be performed by replacing the target stop member 134 or other structural parts of the drop target assembly 118. As can be understood, servicing of the drop target assembly 118 can be performed quickly and at a minimum cost in both labor and parts.

In comparison, in the prior art drop target assembly 10 the task of replacing one target, for example target 16, is extremely complicated. Servicing or replacement of the target 16 requires dismantling the cross bar 28 from the levers 26, removing the rod 30 and the springs attached to the trigger or arm 32. The trigger 32 is then removed which releases target 16 allowing its removal and replacement. Reassembly of each of the structural parts is necessary before servicing is complete.

The drop target assembly of the present invention allows designers a new alternative in laying out the play field of pinball machines. A wide variety of arrays and number of drop targets is now available using the drop target assembly of the present invention. In addition to the increased design opportunities, the drop target assembly of the present invention reduces maintenance costs of pinball machines including the drop target assembly of the present invention.

Many modifications and variations of the present invention are possible in light of the above teachings. Thus, it is to be understood, that, within the scope of the appended claims, the invention can be practiced other than as specifically described in the above description.

What is claimed is:

1. A drop target assembly for a pinball type amusement machine, comprising:

a frame, a single target member mounted on said frame, means for moving said target member from a lowered position to an elevated position, means for releaseably latching said target member in said elevated position, and a target stop member mounted on said frame for movement by said moving means, said target stop member mounted for movement along a longitudinal axis of said target member to engage and move said target member into said elevated position.

2. The drop target assembly for a pinball type amusement machine claimed in claim 1 wherein said moving means includes a solenoid with an elongated plunger, said solenoid mounted on said frame with the direction of movement of said plunger being parallel to the longitudinal axis of said target member.

3. The drop target assembly for a pinball type amusement machine claimed in claim 1 wherein said target stop member is an elongated U shaped channel extending transversely to the longitudinal axis of said target member.

4. The drop target assembly for a pinball type amusement machine claimed in claim 1 wherein said target stop member is engaged by an end of said target member in said lowered position and is out of engagement with said end of said target member in said elevated position of said target member.

5. The drop target assembly for a pinball type amusement machine claimed in claim 1 further comprising a plurality of additional target members spaced closely together.

6. The drop target assembly for a pinball type amusement machine claimed in claim 1 further comprising additional target members mounted in said frame independently of each other allowing removal of each target member from said frame separately of other target members.

7. The drop target assembly for a pinball type amusement machine claimed in claim 1 further comprising an electromagnet on said fame coupled to said moving means for automatically unlatching said target member.

8. A drop target assembly for an amusement machine, comprising:

a frame, at least one elongated target with a longitudinal axis extending along the length of said target, a resetting mechanism for moving said target axially from a first position to a second position, and a latch mechanism for releaseably latching said target in said second position, said resetting mechanism including a target stop member mounted on said frame for reciprocal movement along said longitudinal axis of said target, an end of said target engaging said target stop member in said first position of said target.

9. The drop target assembly for an amusement machine set forth in claim 8 wherein said target stop member includes an elongated U shaped channel extending transversely to said longitudinal axis of said target.

10. The drop target assembly for an amusement machine set forth in claim 8 wherein said resetting mechanism includes a solenoid with a plunger, said plunger extending parallel to said longitudinal axis of said target.

11. The drop target assembly for an amusement machine set forth in claim 8 wherein said resetting mechanism includes a solenoid with a longitudinal axis parallel to said axis of said target.

12. The drop target assembly for an amusement machine set forth in claim 8 further comprising a plurality of said targets in a configuration of parallel, closely spaced rows.

13. The drop target assembly for an amusement machine set forth in claim 8 further comprising an electromagnet on said frame coupled to said resetting mechanism for automatically releasing said target from said latch mechanism.

14. In a pinball machine, the combination comprising:

a play field for supporting a game object, a drop target assembly including at least one game object engagable target, means for elevating said game object engagable target from a nonengagable position below said play field to a play position above said play field, and means for releaseably latching said object engagable target in said play position, said elevating means including a stop member holding said engagable target in said nonengagable position and mounted for perpendicular, vertical reciprocation relative to said play field, and a solenoid with a longitudinal axis extending parallel to the direction of vertical reciprocation of said stop member.

15. The combination claimed in claim 14 wherein said stop member is spaced from said game object engagable target in said play position.

16. The combination claimed in claim 14 wherein said solenoid is connected to said stop member.

17. The combination claimed in claim 14 further comprising means for automatically releasing said latching means while said object engagable target is in said play position and independent of engagement of said object engagable target by said game object.

18. In an amusement device, the combination comprising:

a play field for supporting a game object, a plurality of drop target assemblies closely spaced in parallel rows, each drop target assembly including at least one game object engagable target, each drop target assembly including means for elevating each said game object engagable target from a nonengagable position below said play field to a play position above said play field, each drop target assembly including means for releaseably latching each said object engagable target in said play position, each elevating means including a target stop member on which each engagable target rests in said nonengagable position, each said target stop member mounted for vertical, linear movement on a respective drop target assembly.

19. The combination set forth in claim 18 wherein each said target stop member is a "U" shaped tray.

* * * * *